US005630721A

United States Patent [19]

Nakatsuka

[11] Patent Number: 5,630,721

[45] Date of Patent: May 20, 1997

[54] PLUG CORD CONNECTING STRUCTURE

[75] Inventor: Yoshiaki Nakatsuka, Nara, Japan

[73] Assignee: Seiwa Industry Co., Ltd. (Seiwa Kogyo Kabushiki Kaisha), Osaka, Japan

[21] Appl. No.: 414,617

[22] Filed: Mar. 31, 1995

[30] Foreign Application Priority Data

Jun. 20, 1994 [JP] Japan ..... 6-136207

[51] Int. Cl.[6] ..... H01R 13/44

[52] U.S. Cl. ..... 439/125

[58] Field of Search ..... 439/125, 128, 439/126, 127, 205, 206

[56] References Cited

U.S. PATENT DOCUMENTS 1,962,968 8/1934 Nowosielski ..... 439/125

2,965,871 12/1960 Seyfarth ..... 439/125

3,002,126 9/1961 Noir ..... 439/125

5,297,971 3/1994 Nitta et al. ..... 439/125

*Primary Examiner*—Neil Abrams

*Assistant Examiner*—Eugene Byrd

*Attorney, Agent, or Firm*—Koda and Androlia

[57] ABSTRACT

A plug cord connecting structure used for an automobile engine having a connecting cap provided at one end of the plug cord, said connecting cap having a double tubular structure of outer tube and inner tube made of a synthetic rubber which engage tightly with a tubular wall of a wiring terminal accompanying elastic deformation whereby displacement prevention performance and waterproofness are enhanced, and teeth-like grooves may be formed all around the inner wall of the outer tube of said connecting cap for the engagement of some of the grooves with engaging pieces in accordance with the lead-out direction of the cord, whereby a single connecting structure is applicable to a conventional wiring terminal.

5 Claims, 3 Drawing Sheets

PLUG CORD CONNECTING STRUCTURE

BACKGROUND OF THE INVENTION

1. Field of the Invention

This invention relates to a plug cord connecting structure whereby a distributor and a spark plug or a distributor and an ignition coil are connected in an automobile engine compartment.

2. Prior Arts

A plug cord which connects a distributor and an ignition coil or a distributor and a spark plug of the engine in an automobile engine compartment plays an important role in leading a high voltage generated on the side of an ignition coil to the side of a distributor and a spark plug without a loss of voltage. Therefore, in a connecting structure used to connect a plug cord with a wiring terminal, there must be taken measures to prevent the displacement of a cord from a terminal and to prevent water from coming in when the engine compartment is washed, etc.

Conventionally, a plug cord connection is generally made by using a connecting cap made of a synthetic rubber superior in its electric insulating properties and waterproofness which is tightly fit over a tubular wall of a wiring terminal.

However, said construction only provides a single waterproof structure by fitting the connecting cap over the wiring terminal and is not sufficient in view of the waterproofness, so that further improvement in waterproofness has been desired.

Recently, there have been demands for reducing the space of the engine compartment and the size and weight of engine components, so that reductions in size and weight of the plug cord have also been desired. Accordingly, the cord diameter has been changed from the conventional 7 mm to 5 mm. If the plug cord diameter is changed to 5 mm, the wiring terminals of the distributor, ignition coil and spark plug also need to be changed to accommodate the 5 mm cord. However, this would enforce a change in all components in the ignition system of the engine.

Currently, not all components have been changed to accommodate the 5 mm cord, and only the plug cord connecting structure is changed as follows. That is, a connecting element of the plug cord is made to have a 5 mm diameter, and while the wiring terminal is maintained in the conventional configuration which accommodates the 7 mm plug cord, a terminal connecting element only is changed to accommodate the 5 mm cord. In addition, an insulation member of the plug cord connecting element is made of an elastic synthetic rubber material which tightly fits in the tubular wall of the wiring terminal in view of waterproofness. Further, as a countermeasure to prevent the displacement of the connecting element from the wiring terminal, a fixing cap made of a synthetic resin is placed over the insulation member and engaging holes of elastic engaging portion formed on the fixing cap are engaged and fixed with engaging pieces formed on the tubular wall of the wiring terminal.

However, this construction still provides only a single waterproof structure and is not sufficient in the waterproofness. Moreover, the fixing caps must be manufactured using different molds for each plug, because the locations of a cord outlet and an engaging portion formed on the cap vary depending on a lead-out direction of the plug cord, so that the connection structure using a fixing cap takes high manufacturing costs.

Furthermore, as the engaging pieces are formed on the tubular wall of the wiring terminal, a standard plug cord cannot be used as a substitute when exchanging the plug cord, and the same type of plug cord with a fixing cap must be used as a genuine plug. Therefore an inexpensive repair plug cord having high waterproofness has been desired.

SUMMARY OF THE INVENTION

It is therefore an object of the present invention to provide a plug cord connecting structure having a high level of waterproofness and displacement prevention capability.

Another object of the present invention is to provide a plug cord connecting structure which can also be used as a repair unit in connection with a wiring terminal having engaging pieces.

In order to achieve the above objects, the inventor has made earnest researches and found that the displacement of a plug cord can be prevented as well as in the case of the structure using the fixing cap and a higher waterproofness can be obtained, when a connecting cap having a double structure of outer and inner tubes is employed to grip tightly an tubular wall of the wiring terminal with the outer tubes and the inner tubes.

Therefore, the present invention provides a plug cord connecting structure for connecting a distributor and a spark plug or a distributor and an ignition coil having a connecting cap provided at one end of the plug cord, said connecting cap comprising as a single unit an outer tube fitting over a tubular wall of a wiring terminal, an inner tube from the inside of which a cord connecting element protrudes, and a support member that supports said cord connecting element and a part of a connecting cord, and said outer tube and inner tube is tightly capped on the tubular wall of the wiring terminal.

Using the above construction, the outer and inner tubes come into tight contact with the tubular wall of the wiring terminal, which markedly improves displacement prevention when compared with the conventional structures where the contact is obtained using only an outer or inner tube, while waterproofness also improves markedly.

The outer and inner tubes may be formed to accommodate the configuration of the wiring terminal. Normally, there is a fixed connecting element at the bottom of the tubular wall of the terminal, and the inner wall of the terminal is tapered so that the space inside the inner wall becomes smaller toward the bottom of the tubular wall. Therefore, it is preferable to have the connecting element of the cord protrude from the inner tube and to have the inner tube formed in a short conical shape with a diameter that is the same as or slightly larger than the inner diameter of the tapered wall and matching the contours of the tapered inner wall so that the tight contact may be obtained through its elastic deformation. It is preferable to make the outer tube longer than the inner tube and to make an inner diameter the same as or slightly smaller than the outer diameter of the wiring terminal so that the tight contact and the high waterproofness may be obtained by means of its elastic deformation. In consideration of these capabilities, as well as its electric insulation property, a synthetic rubber material is the best to be used for the connecting cap.

However, when used as a repair unit for a plug cord with a fixing cap, the above construction only does not allow the engagement of the outer tube over the wiring terminal, because there are engaging pieces on the outer surface of the tubular wall of the terminal to engage with and fix the fixing cap. Therefore, as a result of search for a connecting structure which may be used for a terminal with engaging pieces while using the above double-structure cap, the inventor has found that if teeth-like grooves are formed all around the inner wall of the outer tube so that the engaging pieces engage with some of the inner wall grooves, the above single connecting structure may be used regardless of the lead-out direction of the cord.

Therefore, the following construction is adopted as a connecting structure applicable to the terminals with engaging pieces; namely, a plug cord connecting structure used in replacing a plug cord with a fixing cap having an engaging portion that detachably engages with engaging pieces formed on the tubular wall of the wiring terminal, wherein teeth-like grooves are formed all around the inner wall of the outer tube of said connecting cap and the plug cord is connected to the terminal with an engagement of the inner wall grooves with said engaging pieces in accordance with the lead-out direction of the cord, and the tubular wall of the wiring terminal are sandwiched and gripped by said outer and inner walls.

As the connecting cap has a double structure of an outer tube and an inner tube as described above, it can tightly grip the wall of the terminal, so that its displacement prevention and waterproofness are markedly improved and a very safe plug cord can be provided.

In addition, as teeth-like grooves are formed all around the inner wall of the outer tube, regardless of the location of the engaging pieces of the wiring terminal, some of the grooves can engage with said pieces and the cord may be placed in the desired direction, so that a single connecting structure may be used.

Therefore, the connecting structure of the present invention can be used as a repair plug cord to replace a plug cord with a fixing cap. In addition, only one type of mold may be used to form the cap and the manufacturing cost can be reduced

BRIEF DESCRIPTION OF THE DRAWINGS

The invention will now be described by way of example only; with reference to the accompanying drawings in which.

DETAILED DESCRIPTION OF THE INVENTION

Figure 1:
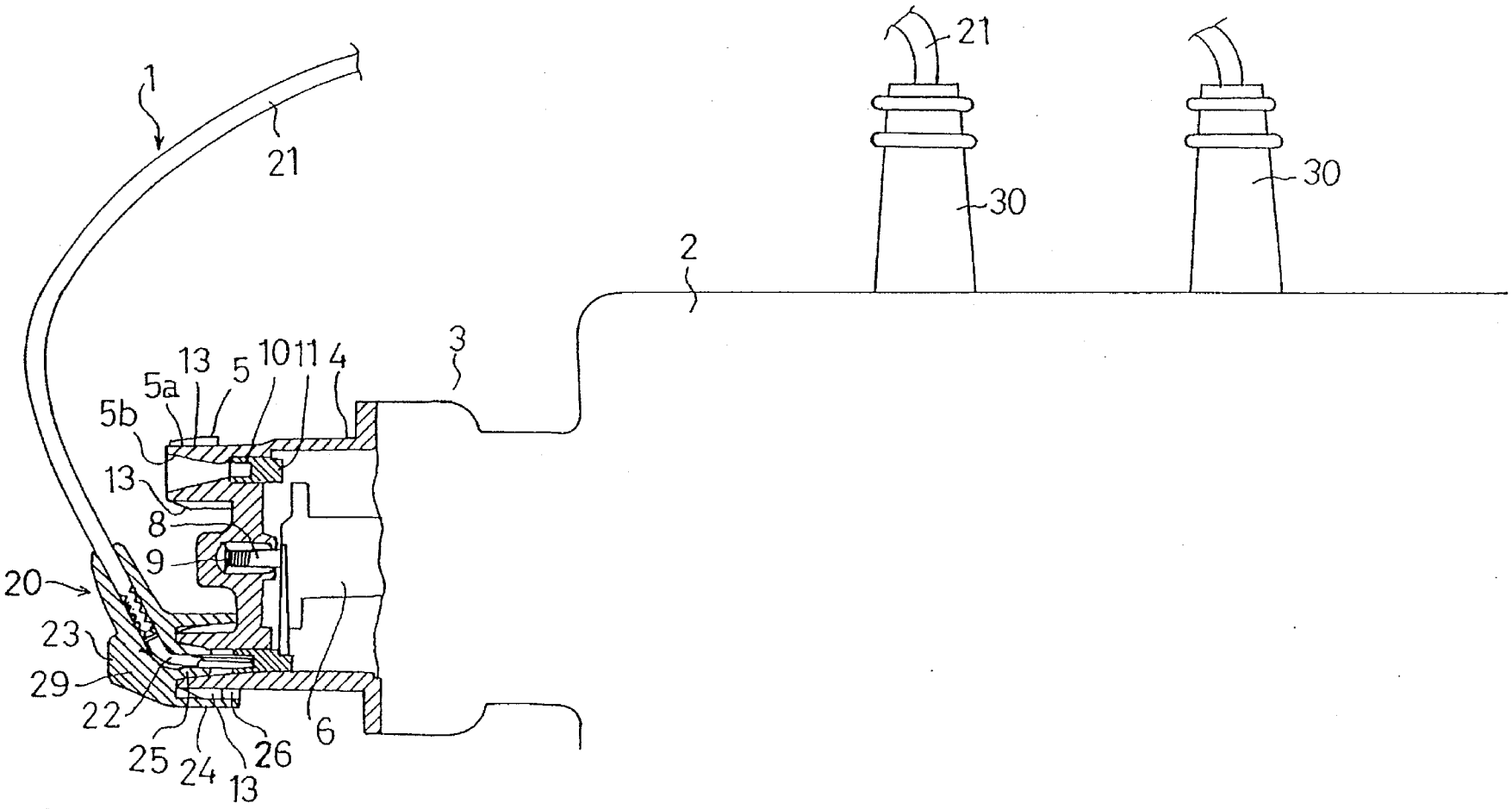
FIG. 1 is a plan view of an engine showing one embodiment of the plug cord connecting structure of the present invention.

As shown in FIG. 1, a plug cord 1 of this embodiment connects spark plugs (not shown in the drawing) of an engine 2 and a plurality of peripheral terminals 5 on a distributor cap 4 of a distributor 3. Naturally, a similar connecting structure may be used for the connection between an ignition coil and the distributor cap, but since a description thereof would be repetitive, it is omitted, and only the connection with the peripheral terminals on the distributor cap as wiring terminal will be explained.

The distributor 3 provides with a distributor cap 4 and a rotor 6, as well known, and a contact piece 8 which transmits high voltage to a center electrode of the rotor 6 is incorporated in the center of the top of cap 4 and is pressed against the rotor 6 by means of a spring 9.

Disposed at an inner peripheral portion of the top of the distributor cap 4 are segments 11 which contact with fixed connecting elements 10 of the peripheral terminals 5. Secondary voltage is caused to spark in the gap between the tip of rotor 6 and the segments 11 so that the voltage is transmitted to the segments 11.

Figure 4:
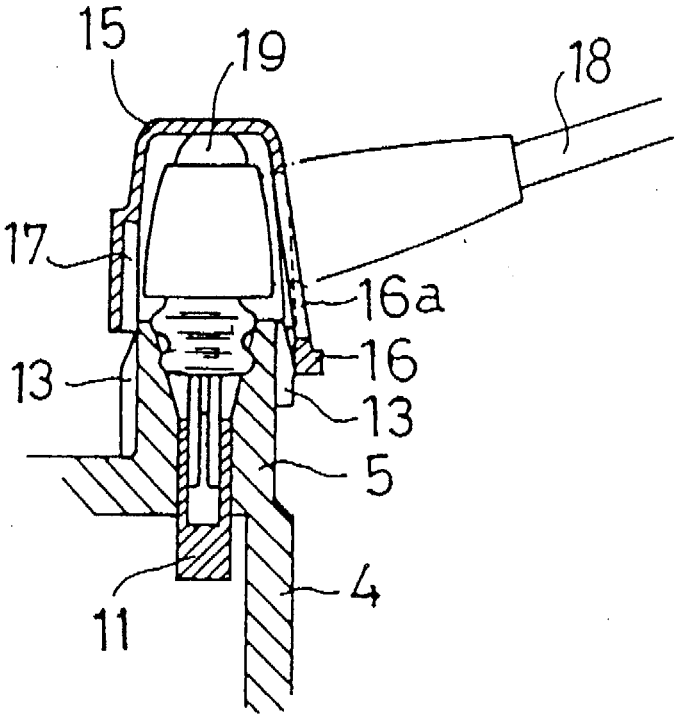
FIG. 4 PRIOR ART
FIG. 4 is a cross-sectional view of a plug cord with a fixing cap.

A pair of engaging pieces 13 are formed on and protrude from an outer wall of the peripheral terminal 5 which accommodate a 7 mm cord. These engaging pieces 13 are for engaging with and fixing a plug cord fixing cap, which is a conventional art shown in FIG. 4. Since this embodiment provides a plug cord connecting structure which can be also used as a replacement for a plug cord with a fixing cap, the fixing cap is also briefly explained herein. FIG. 4 is a cross-sectional view showing a plug cord with a fixing cap. In the drawing, the pair of engaging pieces 13 detachably engage with an engaging hole 16*a* of elastic engaging portion 16 formed by notching off a part of fixing cap 15 and also with an engaging groove 17. The displacement of the plug cord from the peripheral terminal 5 is prevented by pressing the fixing cap 15 so that the engaging hole 16*a* of the elastic engaging portion 16 is hooked on the bottom of the engaging piece 13. In FIG. 4, reference numeral 18 indicates a plug cord and 19 indicates a cord outlet formed on the fixing cap 15.

The plug cord 1 of the present invention can be used as a replacement or repair cord for the above plug cord 18 having the fixing cap, and its connecting portion 20 has the construction described below.

The connecting portion 20 of the plug cord 1 on the side of the distributor comprises as one unit a connecting element 22 to accommodate a 5 mm cord and a connecting cap 23 which covers the connecting element. Said connecting element is caulked onto the tip of a connecting cord 21 having a 5 mm diameter and bent like an elbow so that it aligns with a lead-out direction of the cord.

The connecting element 22 is made by forming iron or brass plated with zinc, nickel, etc. in a cylindrical shape and then cutting said cylinder in half vertically so that it is capable of elastic deformation in the direction of the radius. Said connecting element is tightly fit in the terminal connecting element of cylindrical shape.

Figure 2:
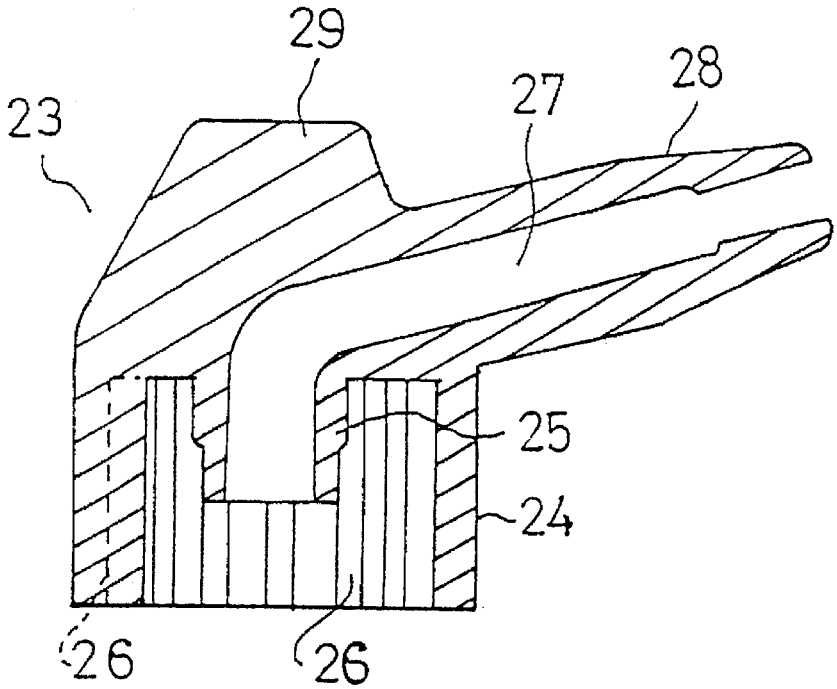
FIG. 2 is a cross-sectional view of the connecting member.
Figure 3:
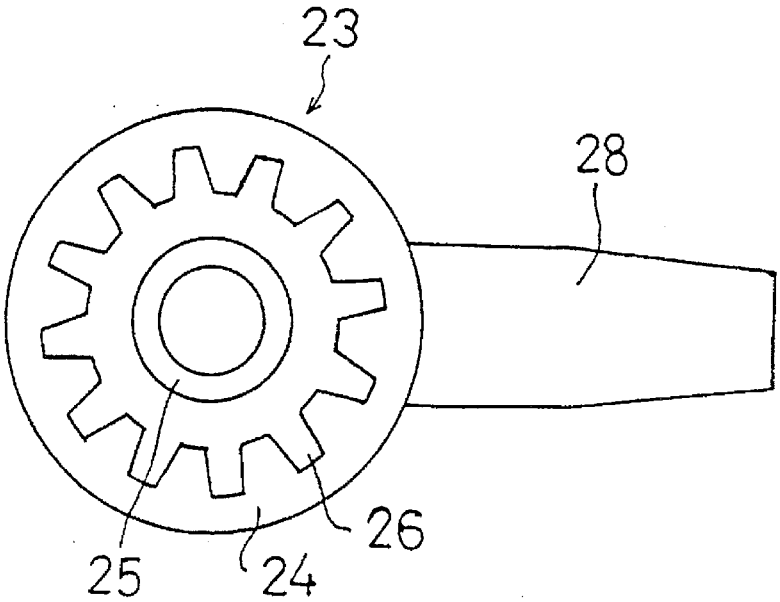
FIG. 3 shows the bottom of the connecting member.

The connecting cap 23 is made of a synthetic rubber material having waterproofness, electric insulating properties and elasticity and comprises as one unit an outer tube 24 fitting over the outer wall 5*a* of the peripheral terminal 5, an inner tube 25 fitting in the inner wall 5*b* of the peripheral terminal 5 and from which the connecting element 22 protrudes, and a support member 29 which supports the cord connecting element 22 and a part of the connecting cord 21, as shown in FIG. 2.

The inner tube 25 is shorter than the outer tube 24 so that the tip of the connecting element 22 protrudes from it, and the outer tube 24 has a height that allows the tip of the connecting element 22 to protrude outward. In addition, grooves 26 are formed at equal intervals all around the inner wall of the outer tube 24 so as to engage with the engaging pieces 13.

In FIG. 2, 27 indicates a fitting hole for the cord and the connecting element 22 which extends to a rear end 28 of the support member 29. In order to join the connecting cap 23 and the connecting cord 21, the connecting cord 21 is inserted through the fitting hole 27 of the connecting cap 23, and then the connecting element 22 is caulked onto the tip of the connecting cord 21, and thereafter the connecting element 22 is disposed at a predetermined position by pulling back the connecting cord 21. As the connecting element 22 is bent like an elbow, it is prevented from disengaging from the connecting cap 23.

Connecting portion 30 with the spark plug shown in FIG. 1 is not significantly different from the conventional art and is not directly related to the present invention, so that detailed description is omitted. As to connecting element, a connecting element for a 7 mm cord is caulked onto a tip of a 5 mm cord so that it will accommodate a spark plug for a 7 mm cord.

In order to connect the plug cord 1 of the present invention in place of a plug cord 18 having a fixing cap 15, the plug cord 18 is first removed and the connecting cap 23 of the plug cord 1 is pushed into the peripheral terminal 5 on the distributor cap 4 so that the outer tube 24 and inner tube 25 engage therewith. The inner diameter of the outer tube 24 is formed to be the same as or slightly smaller than the outer diameter of the peripheral terminal 5 and the outer diameter of the inner tube 25 is the same as or slightly larger than the inner diameter of the peripheral terminal 5. Accordingly the outer tube 24 and inner tube 25 are tightly engaged with the wall of the peripheral terminal 5 when inserted into the peripheral terminal accompanying elastic deformation, so that the displacement from the peripheral terminal 5 is effectively prevented.

As a result of this engagement, the connecting element 22 of the plug cord 1 is electrically connected with the fixed connecting element of the terminal 5, and besides double waterproof seal is obtained by the tight contact between the inner tube 25 and the terminal inner wall and between the outer tube 24 and the terminal outer wall, which provides superior waterproofness with in comparison with conventional constructions.

Moreover, when making the above connection, the connecting cap 23 may engage with the peripheral terminal 5 in alignment with the lead-out direction of the cord. The inner wall grooves 26 of the outer tube 24 engage with the engaging pieces 13 which are located at positions corresponding to the grooves. Therefore, regardless of the position of the engaging pieces 13 of the peripheral terminal 5, the same connecting cap may be used and the lead-out direction of the cord may be set at any desired direction. Therefore, unlike in the case of the conventional fixing cap 15, it is not necessary to manufacture caps using different molds for each terminal 5. Namely, the connecting caps of the same construction may be manufactured, and consequently manufacturing and management costs may be greatly reduced.

Although the above embodiment shows an example in which a plug cord having a 5 mm diameter is connected to a currently used distributor cap for a 7 mm diameter cord, the present invention is not limited to this case, and may naturally be applied to a connection with a distributor, an ignition coil or a spark plug intended for a 5 mm cord. In addition, the connection structure of the present invention may naturally be applied to terminals on the side of the spark plugs or ignition coil.

As is clear from the detailed description provided above, the plug connection structure of the present invention provides an improved structure wherein the displacement of the cord is effectively prevented and double waterproof seal is attained, because the connecting cap engages tightly with the wall of the wiring terminal by means of the outer tube and the inner tube. A synthetic rubber material capable of elastic deformation, as shown in the embodiment, is preferred to be used, because the waterproofness and displacement prevention can be effectively enhanced.

In addition, as the inner grooves are formed all around the inner wall of the outer tube, the plug cord of the present invention may be used as a replacement for a plug cord with a fixing cap, and consequently a single connecting structure may be used for various terminals, so that the manufacturing cost may be greatly reduced.

We claim:

1. A plug cord connecting structure for connecting a distributor and a spark plug or a distributor and an ignition coil having a connecting cap provided at one end of the plug cord, said connecting cap as a single unit comprising:

an outer tube fitting over a tubular wall of a wiring terminal, said outer tube having an inner diameter equal to or small to the outer diameter of said wiring terminal;

an inner tube fitting in a tubular wall of said wiring terminal and from the inside of which protrudes a cord connecting element, said inner tube having an outer diameter equal to or greater than the inner diameter of the tubular wall of said wiring terminal; and a support member which supports said cord connecting element and a part of a connecting cord; and wherein said outer tube and inner tube engaged respectively with outer and inner surfaces of said tubular wall to be tightly capped on the tubular wall of the wiring terminal.

2. A plug cord connecting structure claimed in claim 1, wherein teeth-like grooves are formed all around the inner wall of the outer tube of said connecting cap and the plug cord is connected to the wiring terminal with an engagement of said inner wall grooves with said engaging pieces in accordance with the lead-out direction of the cord, and the outer tube and inner tube are tightly capped on the tubular wall of the wiring terminal, whereby a plug cord connecting structure used in replacing a plug cord with a fixing cap having an engaging portion that detachably engages with the engaging pieces formed on the tubular wall of the wiring terminal is provided.

3. A plug cord connecting structure claimed in claim 1, wherein said connecting cap comprises a synthetic rubber material having electric insulation properties and waterproofness and elasticity.

4. A plug cord connecting structure claimed in claim 2, wherein said connecting cap comprises a synthetic rubber material having electric insulation properties and waterproofness and elasticity.

5. A plug cord according to claim 1, wherein said inner tube is shorter in length than said outer tube.

* * * * *